US008162162B2

(12) United States Patent
Hata et al.

(10) Patent No.: US 8,162,162 B2
(45) Date of Patent: Apr. 24, 2012

(54) RESIN-MADE STORAGE CONTAINER

(75) Inventors: Hiroaki Hata, Tokyo (JP); Naokazu Fujita, Tokyo (JP); Toshimasa Tanaka, Tokyo (JP); Masaaki Sasaki, Tokyo (JP); Takao Iizuka, Tokyo (JP)

(73) Assignees: Suntory Holdings Limited, Osaka (JP); Yoshino Kogyosho Co., Ltd., Tokyo (JP)

( * ) Notice: Subject to any disclaimer, the term of this patent is extended or adjusted under 35 U.S.C. 154(b) by 290 days.

(21) Appl. No.: 11/919,671

(22) PCT Filed: May 2, 2006

(86) PCT No.: PCT/JP2006/309165

§ 371 (c)(1), (2), (4) Date: Oct. 31, 2007

(87) PCT Pub. No.: WO2006/120977

PCT Pub. Date: Nov. 16, 2006

(65) Prior Publication Data

US 2009/0065468 A1 Mar. 12, 2009

(30) Foreign Application Priority Data

May 10, 2005 (JP) ..... 2005-137500

(51) Int. Cl.
*B65D 1/18* (2006.01)

(52) U.S. Cl. ..... 215/382; 215/379; 215/383; 215/381; 215/384; 220/666; 220/669; 220/23.4; 220/379; 220/646

(58) Field of Classification Search ..... 215/382, 215/379, 383, 12.2, 381, 384; 220/666, 669, 220/23.4, 359.3, 379, 521, 62.22, 646
See application file for complete search history.

(56) References Cited

U.S. PATENT DOCUMENTS 2,917,766 A * 12/1959 Ciffo ..... 206/15.2
(Continued)

FOREIGN PATENT DOCUMENTS

JP A 8-11856 1/1996
(Continued)

*Primary Examiner* — Anthony Stashick
*Assistant Examiner* — Cynthia Collado
(74) *Attorney, Agent, or Firm* — Oliff & Berridge, PLC

(57) ABSTRACT

The object of this invention is to provide a container having a reduced area of vacuum-absorbing panels and thus acquiring improved appearance and having strength against a pressure drop, i.e., the strength enough to retain the shape of the container even when there is a pressure drop inside the container.

A shoulder portion or a bottom portion of a resin-made storage container is molded by aligning one or two groups of three corners and one or two groups of three pillars vertically and in parallel to the central axis of the container. Each group of three corners is a part of the corners forming a cross-section of a regular enneagon and being connected to either the shoulder portion or the bottom portion, and the lines connecting these three corners form a regular triangle. Each group of three pillars is a part of the pillars belonging to the body and forming a cross-section of a hexagon, and the lines connecting these three pillars form a regular triangle.

If there is a pressure drop inside the container due to a decrease in the temperature of the contents, stress builds up inside the body of the container in such a way that the body deforms into a regular triangular prism, with vertically aligned corners/pillars serving as the three angles. As a result, the container has an enhanced level of strength against the force coming from any direction. With the shape stabilized, the container has also high resistance to buckling.

8 Claims, 7 Drawing Sheets

U.S. PATENT DOCUMENTS

| | | | | | |
|---|---|---|---|---|---|
| D191,641 | S | * | 10/1961 | Du Pree | D9/541 |
| D294,463 | S | * | 3/1988 | Lang | D9/520 |
| D295,375 | S | * | 4/1988 | Lang | D9/434 |
| 4,749,092 | A | * | 6/1988 | Sugiura et al. | 215/381 |
| D322,562 | S | * | 12/1991 | Narsutis | D9/538 |
| D340,646 | S | * | 10/1993 | Jeanjean | D9/545 |
| D346,556 | S | * | 5/1994 | Sirico et al. | D9/538 |
| 5,593,056 | A | * | 1/1997 | Mero et al. | 215/382 |
| D386,418 | S | * | 11/1997 | Edstrom et al. | D9/538 |
| D400,105 | S | * | 10/1998 | Beechuk et al. | D9/531 |
| 7,051,892 | B1 | * | 5/2006 | O'Day, Jr. | 215/383 |
| 2009/0130352 | A1 | * | 5/2009 | Komiya et al. | 428/35.7 |

FOREIGN PATENT DOCUMENTS

| | | |
|---|---|---|
| JP | A 2001-341717 | 12/2001 |
| JP | A 2002-293315 | 10/2002 |
| JP | A 2003-63514 | 3/2003 |

* cited by examiner

[Fig.1]
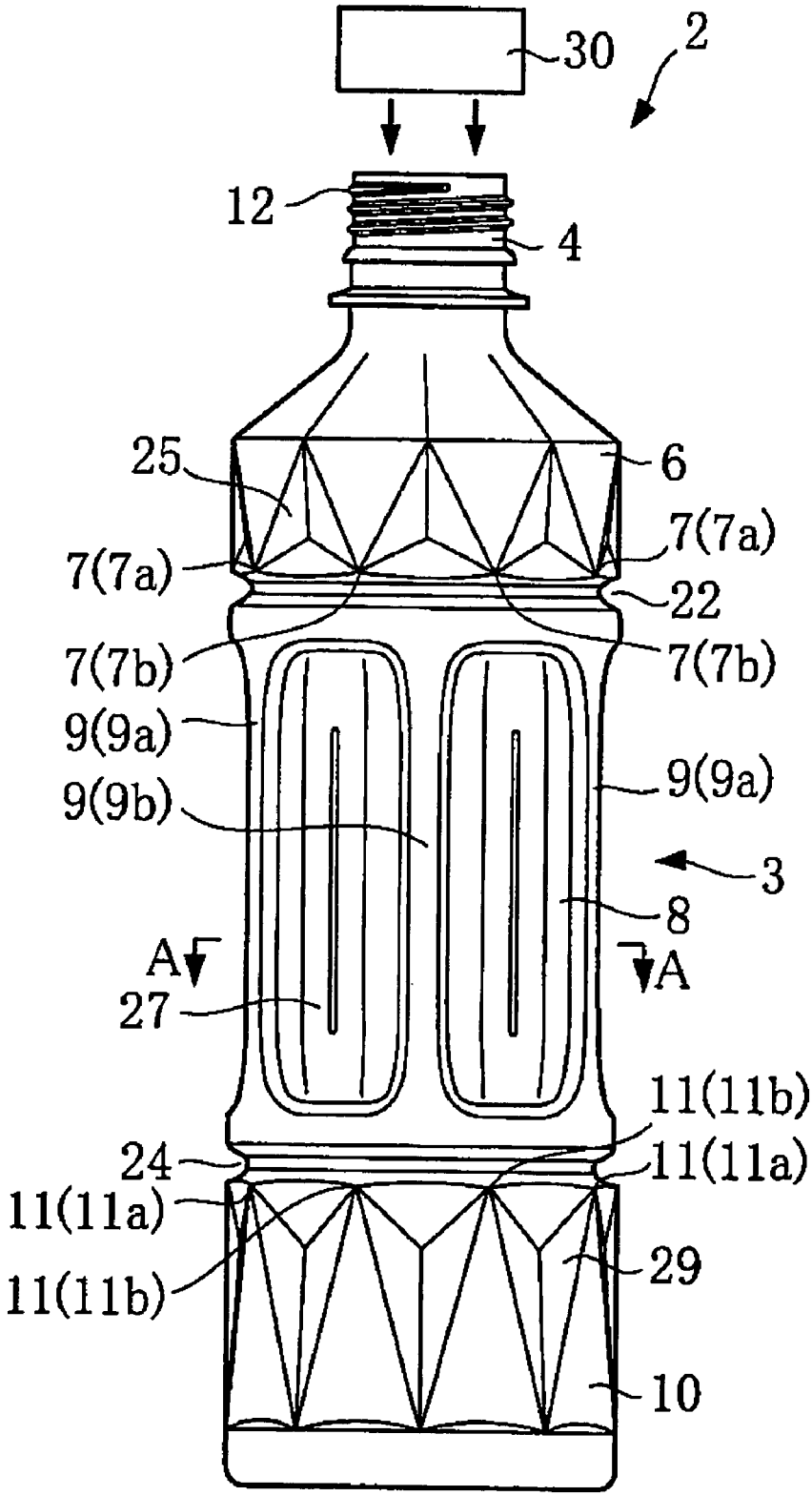

[Fig. 2]
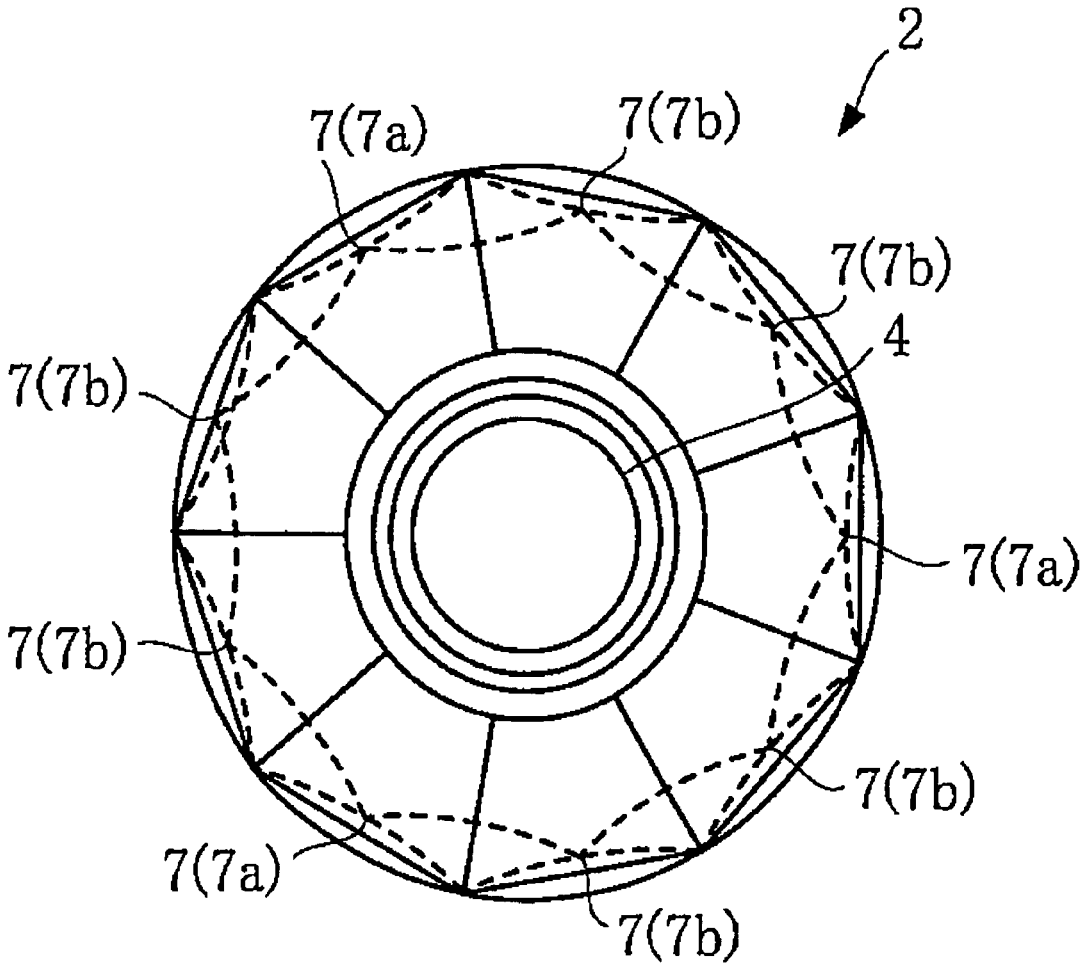

[Fig. 3]
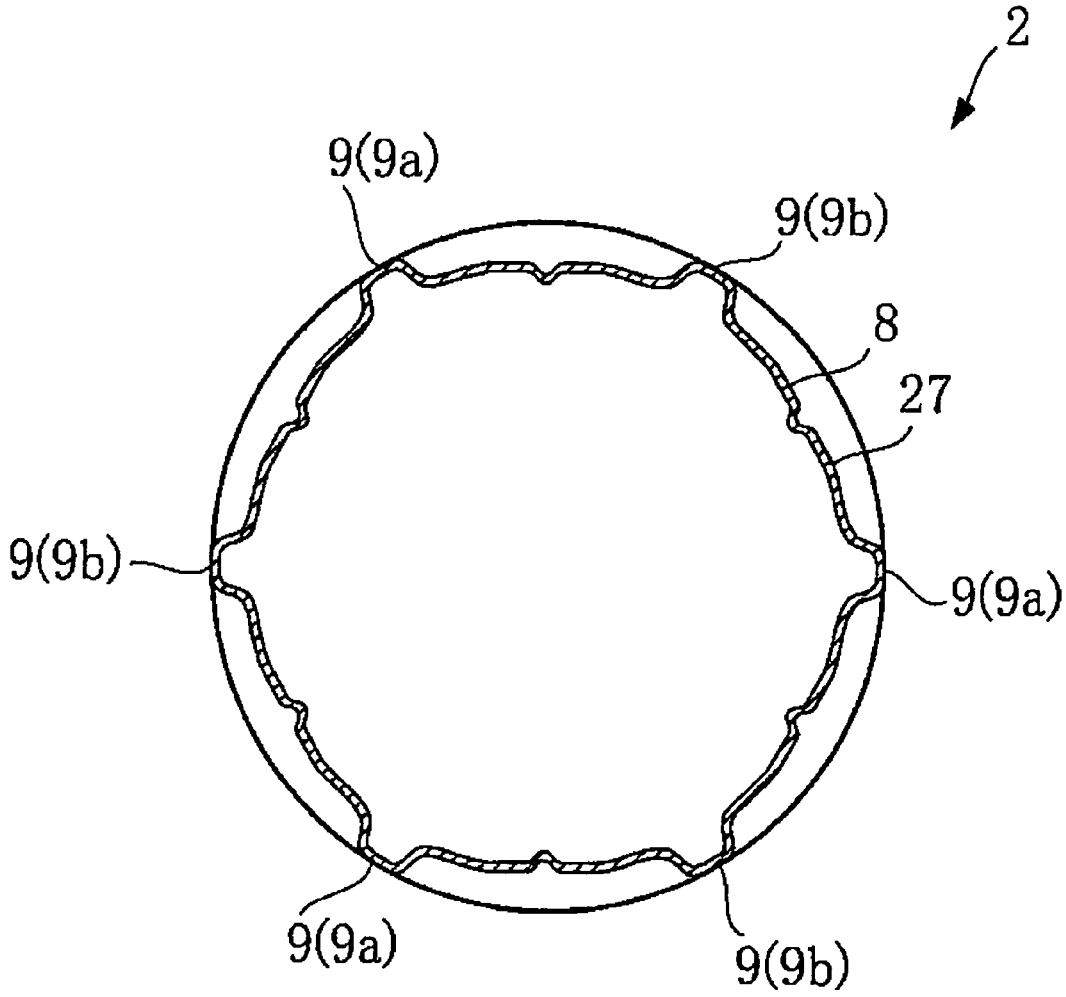

[Fig. 4]
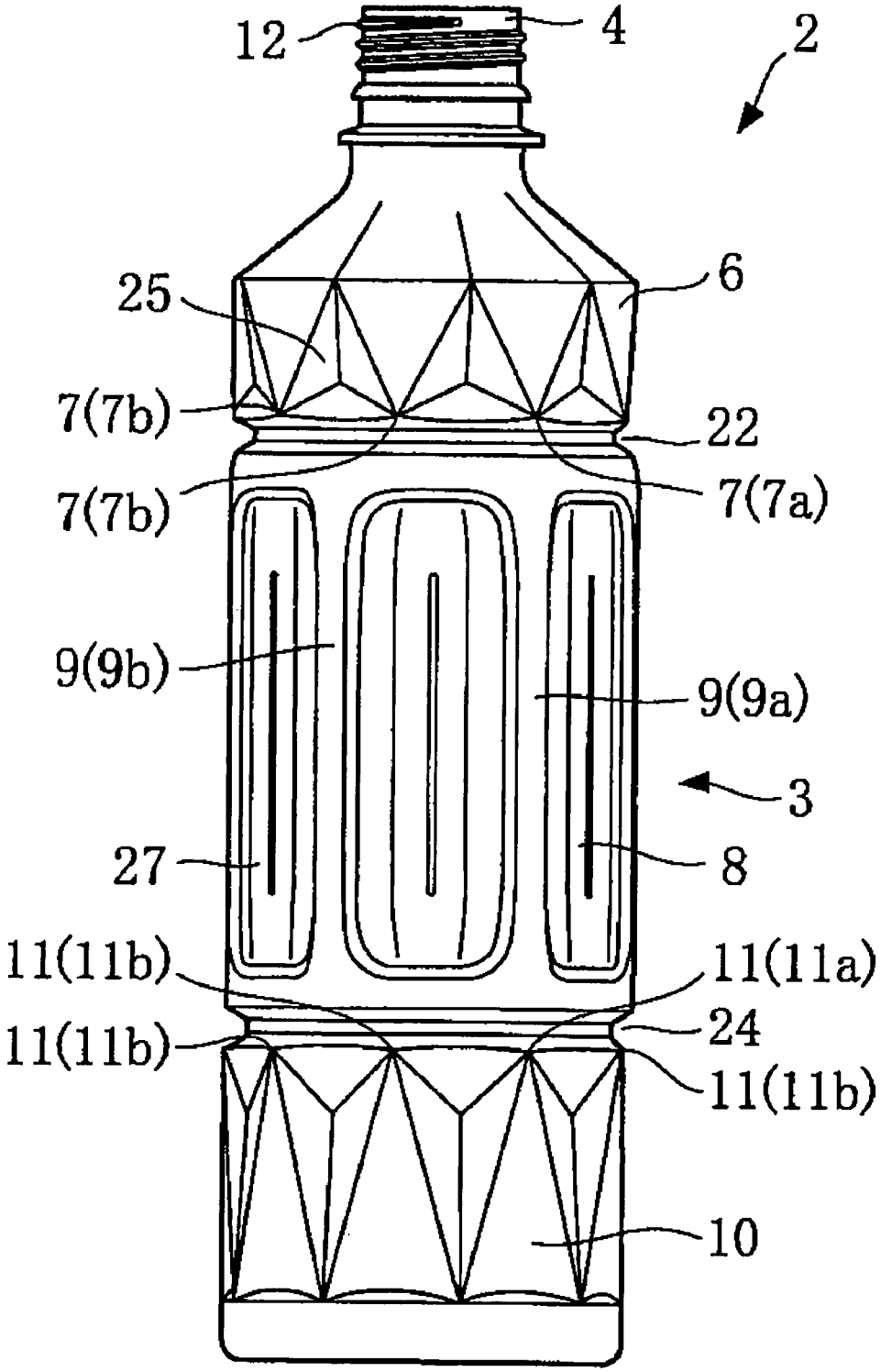

[Fig. 5]
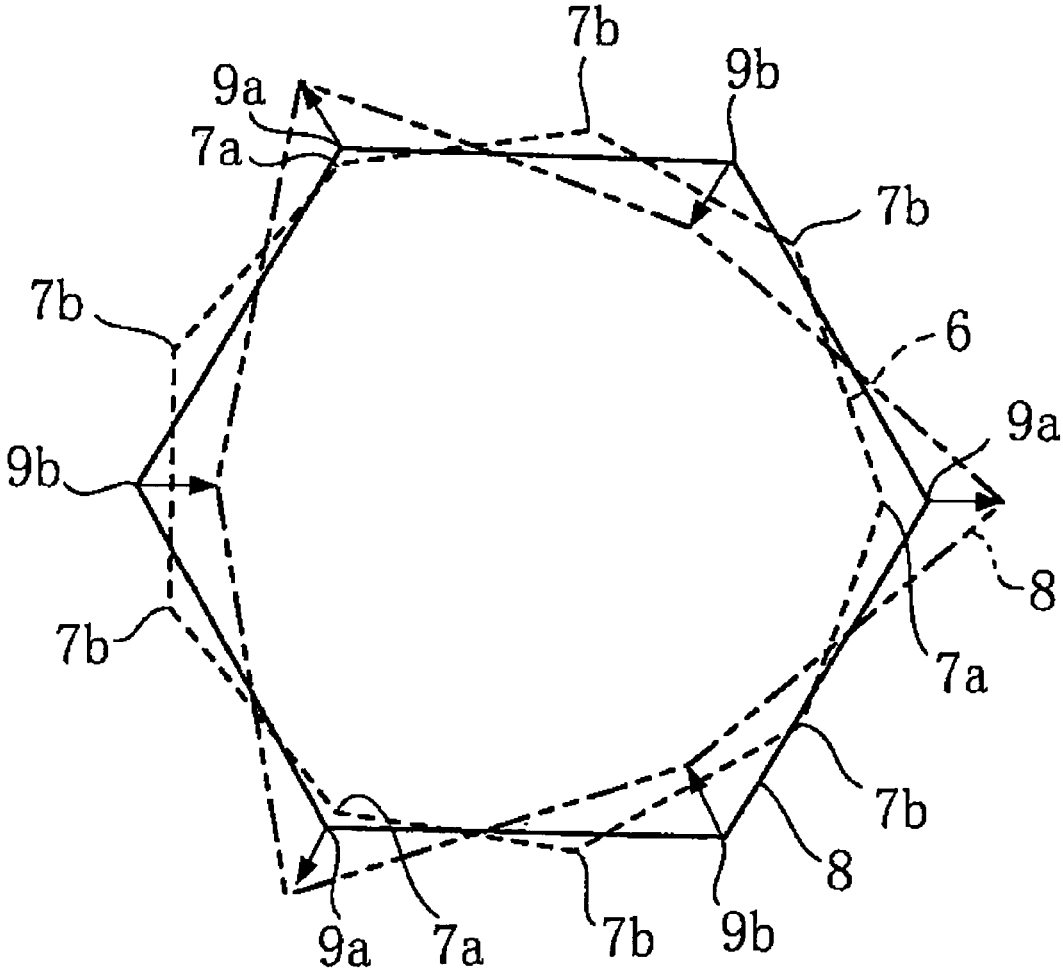

[Fig. 6]
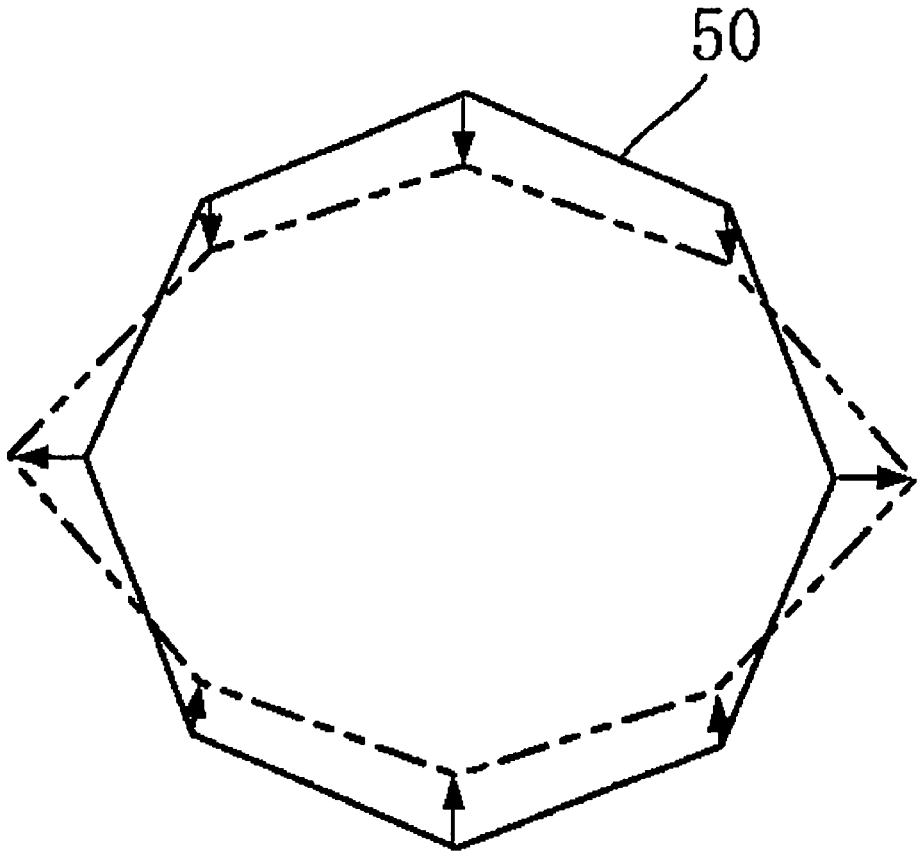

[Fig. 7]
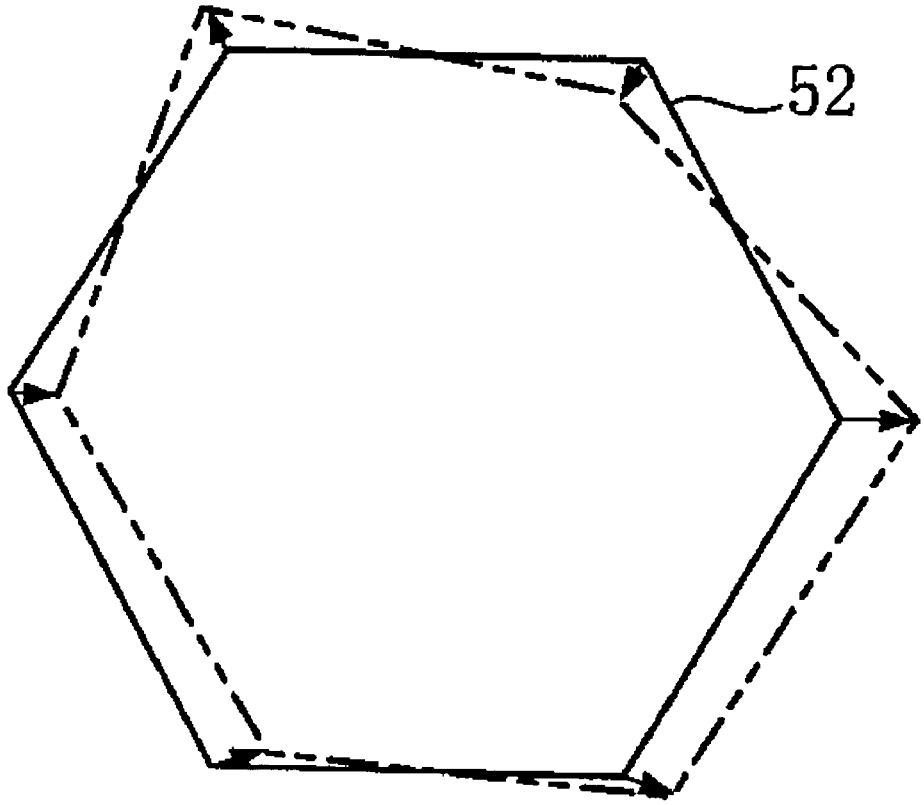

RESIN-MADE STORAGE CONTAINER

TECHNICAL FIELD

This invention relates to a resin-made storage container having high strength against pressure drop inside the container and having a high shape-retaining property.

Vacuum-absorbing panels are provided on the sidewall of conventional resin-made storage containers in a cylindrical shape, such as, for example, PET bottles, in which drinking water and the like are stored. If there is a pressure drop inside the container when the contents in the container are cooled, these vacuum-absorbing panels are displaced inward to prevent the entire container from deforming due to pressure reduction inside the container.

In the meantime, there is a requirement for the vacuum-absorbing panels to have a smaller area from a point of view of container design.

Some examples are known to have the vacuum-absorbing panels formed in an inclined direction to the central axis of the container.

[Patent document 1] JP Application (OPI) No. 2003-63514

DISCLOSURE OF THE INVENTION

Technical Problem to be Solved by the Invention

However, if the area of the vacuum-absorbing panels is reduced, then there is a decrease in the vacuum-absorbing capability of the container. As a result, the container will become unable to deal with the reduction in the volume of the contents that occurs at the time of cooling. As shown in FIG. 6, an octagonal cylinder 50 having a vacuum-absorbing panel on each side is pushed from both of the front and the rear, and the cross-sectional shape deforms into an elliptical shape shown in chain double-dashed lines. As another example, a hexagonal cylindrical container 52 of FIG. 7 deformed in an irregular cross-sectional shape, as shown in chain double-dashed lines in FIG. 7.

If such deformation occurs in the container, it significantly decreases not only the container appearance, but also the container strength in the portions where thickness was reduced by the elliptical deformation. Thus, problems arise in the aspect of strength and in the container handling because buckling may occur. Therefore, if the area of the vacuum-absorbing panels is reduced merely from a design point of view, the container may deform beyond an allowable range for the container, at the time when the contents were cooled.

The object of this invention is to provide a resin-made storage container that has high flexibility in design obtained by reducing the area of vacuum-absorbing panels, has improved appearance of the container, and has strength against deformation caused by a pressure drop inside the container, i.e., the strength enough to retain the shape of the container.

A resin-made container of this invention has the construction described below to solve the above-described technical problem.

Means of Solving the Problem

The container comprises a neck disposed on the top, a sidewall of a body under the neck, and a bottom portion disposed in the lower part of the body. The sidewall of the body comprises at least two parts that are disposed in the upper and lower portions of the body. Each part has a regular 3n-angular shape where n is an integer of 2 or more. The integer n in a part adjacent to each other is different from the integer n in the other part. These integers n are in a prime relationship with each other.

The construction of the resin-made container is such that, in multiple, mutually adjacent parts including those parts disposed at least in the upper or lower portion of the body, three selected corners of a regular triangle formed by the lines connecting these corners are a part of the corners of a regular n-angular shape belonging to respective parts, and are disposed along the lines parallel to the central axis of the container.

To be more concrete, some ribs are formed in the circumferential direction in the sidewall of the resin-made container. These ribs separate the sidewall in 2 to 4 parts (more than 4 is also acceptable). A different number of corners are disposed in each part, and the cross-section of the container has a multi-angular shape having corners in multiples of 3 other than a regular triangle, such as a regular hexagon, a regular enneagon, and a regular dodecagon. Each part only needs to have corners on the sidewall, but need not be in a prismatic shape in which two walls facing each other are parallel Two integers n are in a prime relationship. If an integer n is 2, for example, then another or other integers n should be 3, 5, and/or 7.

By the multiple, mutually adjacent parts including those parts disposed at least in the upper or lower portion of the body, it is meant that at least one of the parts is connected to the shoulder portion, i.e., a slope portion under the neck, or to the bottom portion. If the sidewall comprises 4 parts, for example, then these parts include at least the part in the upper portion or the part connected to the bottom portion, indicating that the adjacent parts are not merely those two parts in the central portion.

The shoulder portion does not merely indicate the area that spreads under the neck in a slope, but is used to include the upper portion of sidewall of the container. Similarly, the bottom portion does not merely indicate the underside of the container, but is used to include the lower portion of the sidewall.

By the corners/pillars disposed in parallel to the central axis, it is not only meant that some groups of corners including a pillar or pillars are aligned vertically. But it is also meant that, when force of contraction is created inside the container due to a pressure drop, the areas on both sides of those aligned corners/pillars are pulled inward, as will be described below, with these corners/pillars acting in unison with one another along the vertical lines and forming sharp angled broken lines that project outward from the original positions in the respective cross-sections. In contrast, in other corners which are not aligned vertically, the corner positions are scattered over the sidewall so that no sharp angled broken line is formed.

When there is a pressure drop inside the container due to the cooling of the contents, the force of contraction acts on the sidewall of the container so as to pull the wall inward. Under the above-described configuration, corners of the part connected to the shoulder portion or the bottom portion are also pulled inward, along with the sidewall of the body. However, since the shoulder portion is connected to the neck, and the bottom portion, to the bottom plate which is parallel to the direction of diameter, these portions do not move in the direction of diameter at the three corners that are aligned vertically. On the other hand, at the corners of the parts that are not vertically aligned but are scattered, the force of contraction is received individually, rather than being received in unity. In such a case, the sidewall tends to be pulled inward so that the wall becomes flat.

If the container experiences the force of contraction that pulls the wall inward, this force acts on the sidewall along vertical lines from the body to the shoulder, or from the body to the bottom, in the case of vertically aligned corners. In that case, the sidewall is not easily pulled inward. On the other hand, in the areas between the vertically aligned corners, corners are scattered in these areas, and the wall tends to be readily pulled inward. Therefore, stress acts inside the container in a manner similar to a case of the container in the shape of a regular triangular prism where the three corners are formed into respective pillars. This configuration greatly improves the container strength and the shape stability alike.

The pressure working inside the container acts on the sidewall so that the container take the shape of a regular triangular prism, as just described. The bottle in this shape has high strength against the force coming from any direction. With a stabilized shape, the container has also high resistance to buckling.

If the pressure inside the container further drops, the force of contraction surely acts on the sidewall to pull it inward. As a result, the container deforms to take the shape of a triangular prism, with three vertically aligned corners/pillars supporting the container as the three angles of the prism, and each area between two adjacent pillars is pulled inward. Actually there is no such deformation, and the sidewall is held approximately in the shape of a hexagon. Due to the action of inner pressure, the container can maintain strength and shape stability.

To be more precise, the shoulder portion or the bottom portion of a container is molded by aligning one or two groups of three corners and one or two groups of three pillars vertically and in parallel to the central axis of the container. Each group of three corners is a part of the corners forming a cross-section of a regular enneagon and being connected to either the shoulder portion or the bottom portion, and the lines connecting these three corners form a regular triangle. Each group of three pillars is a part of the pillars belonging to the body and forming a cross-section of a hexagon, and the lines connecting these three pillars form a regular triangle.

The container can acquire a very strong and stable shape in the case where the corners of the shoulder portion, the pillar or pillars of the body, and the corners of the bottom portion are vertically aligned.

The resin-made container is a bottle made of a PET resin.

Effects of the Invention

The container of this invention has the effects described below.

A blow molding process and the like can be used to mold easily the resin-made storage container having a reduced area of the vacuum-absorbing panels and improved flexibility in design.

When there is a pressure drop inside the container caused by cooling the contents, stress acts on at least the sidewall and the shoulder portion or on the sidewall and the bottom portion in the direction in which the body wall and these portions are shrunk together into a regular triangular prism. The triangular prism has high shape stability and highly improved strength against buckling, as compared to the cross-section of sidewall deformed into an elliptical, flattened, or irregular shape.

The container of this invention can be manufactured by the processes similar to those used for conventional containers, without increasing the cost of production. Since the container is molded merely by setting the corners and pillars of the upper, central, and lower parts of the sidewall in prescribed positions and shapes, there is no large restriction to the flexibility in the appearance of the container.

A preferable result is obtained by using a PET resin to mold the resin-made container.

BRIEF DESCRIPTION OF THE DRAWINGS

FIG. 1 is a front elevational view of the container in an embodiment of this invention.

FIG. 2 is a plan view of the container.

FIG. 3 is a cross-sectional view of the container taken from line A-A.

FIG. 4 is a front elevational view of the container of FIG. 1 shown from another position.

FIG. 5 is an explanatory diagram showing the state of stress applied to the container at the time of a pressure drop.

FIG. 6 is an explanatory diagram showing a conventional container.

FIG. 7 is an explanatory diagram showing a conventional container.

EXPLANATION OF CODES

2. Container
3. Sidewall
4. Neck
6. Shoulder portion
7, 9, 11. Corner
8. Body
10. Bottom portion
12. Male screw thread
22, 24. Rib
25. Recession
27. Vacuum-absorbing panel
30. Cap

A PREFERRED EMBODIMENT OF THE INVENTION

The container of this invention is further described with respect to a preferred embodiment.

FIG. 1 shows a front elevational view of the container.

The container 2 is a PET resin container obtained by blow molding. It comprises a neck 4 in the top portion, a shoulder portion 6 under the neck 4, a body 8 under the shoulder portion 6, and a bottom portion 10 under the body 8. A sidewall 3 comprises a part of the shoulder portion 6, the body 8, and a part of the bottom portion 10.

The neck 4 is provided with a male thread 12 on which a cap 30 is screwed tightly.

The shoulder portion 6 is provided with tetrahedral recessions 25 which are disposed evenly in the sidewall at 9 places. As shown in FIG. 2, corners 7 are disposed alternately with the recessions 25 to form the shape of a regular enneagon in the plan view. Under the shoulder portion 6 is a groove-like rib 22 which is concaved in the direction of the container diameter. The rib 22 has a semicircular shape when it is cut by the plane perpendicular to the central axis of the container (This cut plane is hereinafter referred to as "cross-section." The shoulder portion 6 is connected to the body 8 through the rib 22.

The body 8 is a regular hexagon having six corners 9 around the body 8, as shown in the cross-section of FIG. 3. Vacuum-absorbing panels 27 are disposed on the respective sidewalls of the body 8. Each panel 27 is a square, uneven surface fringed with the sidewalls of the body 8. If inner pressure goes down inside the container 2, the central area of the panel is displaced inward in response to a decreased pressure.

Under the body 8 is another rib 24 having a semicircular cross-section, which like the rib 22, is concaved in the direction of the container diameter. The body 8 is connected to the bottom portion 10 through the rib 24.

As shown in FIG. 1, the bottom portion 10 is provided with tetrahedral recessions 29 evenly in the sidewall. A regular enneagon is formed by the lines connecting the corners 11 disposed at 9 points around the bottom portion 10.

Since the shoulder portion 6 is formed in a regular enneagon by the corners 7, it is possible to select the three corners 7 wherein the lines connecting those corners form a regular triangle. These selected corners 7 are designated as the corners 7*a*. Since the cross-section of the bottom portion 10 is also formed in a regular enneagon, it is possible to select the three corners 11 wherein the lines connecting those three corners form a regular triangle. The selected corners of the bottom portion 10 can be positioned right below the selected corners 7*a* of the shoulder portion 6. These corners selected for the bottom portion 10 are designated as the corners 11*a*.

These corners 7*a* and 11*a* are further aligned vertically with respective three pillars 9*a*, which are selected from among the six pillars 9 on the body 8 in such a way that the lines connecting these three pillars 9*a* form a regular triangle. As a result, the container 2 has a configuration that three pillars 9*a* on the body 8 are almost aligned with the three corners 11*a* of the bottom portion 10 along the three lines pendant from the three corners 7*a* that forms a regular triangle in the shoulder-portion 6.

The container 2 is further described as to its features.

The container 2 is blow molded into the above-described shape. It comprises the shoulder portion 6, the body 8, and the bottom portion 10, each of which has three corners or pillars that are vertically aligned to form regular triangular cross-sections. The container 2 thus molded is filled with contents, and the cap 30 is screwed on the neck 4 to seal the inside.

If the pressure inside the container 2 decreases as by cooling the contents, the vacuum-absorbing panels 27 turn their curve in the reverse direction and cave in to respond to a pressure drop inside the container 2. At the same time, the entire body 8 receives the force that pulls the sidewall of the body 8 inward.

The three pillars 9*a* of the body 8 are positioned right under the three corners 7*a* that form a regular triangle in the shoulder portion 6, and the corners 11*a* of the bottom portion 10 are positioned right under the pillars 9*a*. If the container 2 receives the force that pulls the sidewall of the body 8 inward, the areas on both sides of each pillar 9*a* are pulled inward, as shown in FIG. 5. At respective three pillars 9*a*, there occurs the stress that projects the pillars 9*a* outward from the original positions of the walls of the container 2, instead of pulling the pillars 9*a* inward.

On the other hand, when corners 7*b*, pillars 9*b*, and corners 11*b* receive the force that pulls the walls of the body 8 inward, there occurs the stress that readily pulls these corners and pillars inward to allow the corners/pillars to disappear and to flatten the walls of the body 8 because these corners and pillars are not aligned vertically.

Because of this action, the container 2 having a decreased inner pressure is shrunk in such a way that the body 8 is deformed into a triangular prism (as shown in the chain two-dash line of FIG. 5), wherein the above selected corners 7*a*, pillars 9*a*, and corners 11*a* are the three angles of a regular triangle in the cross-section of the prism. Thus, the container 2 is never deformed irregularly. Moreover, after shrunk into a triangular prism, the container 2 is highly resistant to the pushing force applied in the vertical direction and in the lateral direction as well. Even if the cross-section of the body 8 remains roughly in the shape of a hexagon, the container 2 retains its shape and does not buckle.

Although the container 2 in the above-described embodiment is formed in three parts comprising the shoulder portion 6, the body 8, and the bottom portion 10, it is to be understood that the container of this invention is not limited to such a shape. In addition, this invention is not limited to the container made of a PET resin.

The invention claimed is:

1. A resin-made container, comprising:

a neck disposed in a top portion;

a sidewall connected to the neck; and a bottom portion in a lower part of the sidewall, wherein the sidewall comprises at least two parts disposed in upper and lower portions, each part has a regular 3n-angular shape in a cross-section perpendicular to a central axis of said container where n is an integer of 2 or more, with an integer n in a part adjacent to each other being different from the integer n in an other part and being in a prime relationship with each other such that neither the integer n in the part or the integer n in the other part is an integer multiple of the other; and the construction of the resin-made container is such that, in multiple, mutually adjacent parts including those parts disposed at least in the upper or lower portion of the body, three selected corners of a regular triangle formed by lines connecting these corners are a part of the corners of a regular 3n-angular shape belonging to respective parts, and are disposed along lines parallel to the central axis of the container.

2. A resin-made container, comprising:

a neck opened in a top portion;

a shoulder portion disposed under the neck and having a shape of a regular enneagon in a cross-section perpendicular to a vertically extending central axis of the container;

a body connected to said shoulder portion and having a shape of a regular hexagon in the cross-section perpendicular to the vertically extending central axis; and a bottom portion connected to said body and having a shape of a regular enneagon in the cross-section perpendicular to the vertically extending central axis of the container, wherein a group of three selected corners and a group of three selected pillars are aligned vertically and in parallel to the central axis of the container, said group of three selected corners being a part of the corners that belong to the shoulder portion and forming a cross-section of a regular enneagon, with lines connecting these selected three corners forming a regular triangle, and said group of three selected pillars being a part of the pillars that belong to the body and form a cross-section of a hexagon, with lines connecting these three selected pillars forming a regular triangle.

3. A resin-made container, comprising:

a neck opened in a top portion;

a shoulder portion disposed under the neck and having a shape of a regular enneagon in a cross-section perpendicular to a vertically extending central axis of the container;

a body connected to said shoulder portion and having a shape of a regular hexagon in the cross-section perpendicular to the vertically extending central axis; and a bottom portion connected to said body and having a shape of a regular enneagon in the cross-section perpendicular to the vertically extending central axis of the container, wherein a group of three selected corners and a group of three pillars are aligned vertically and in parallel to the central axis of the container, said group of three selected pillars being a part of the pillars that belong to the body and form a cross-section of a hexagon, with lines connecting these three selected pillars forming a regular triangle, and said group of three selected corners being a part of the corners that belong to the bottom portion and form a cross-section of a regular enneagon, with lines connecting these three selected corners forming a regular triangle.

4. A resin-made container, comprising:

a neck opened in a top portion;

a shoulder portion disposed under the neck and having a shape of a regular enneagon in a cross-section perpendicular to a vertically extending central axis of the container;

a body connected to said shoulder portion and having a shape of a regular hexagon in the cross-section perpendicular to the vertically extending central axis; and a bottom portion connected to said body and having a shape of a regular enneagon in the cross-section perpendicular to the vertically extending central axis of the container, wherein a group of three selected corners, a group of three selected pillars, and another group of three corners are aligned vertically and in parallel to the central axis of the container, said group of three selected corners being a part of the corners that belong to the shoulder portion and form a cross-section of a regular enneagon, with lines connecting these three selected corners forming a regular triangle, said group of three selected pillars being a part of the pillars that belong to the body and form a cross-section of a hexagon, with lines connecting these three pillars forming a regular triangle, and said another group of three selected corners being a part of the corners that belong to the bottom portion and form a cross-section of a regular enneagon, with lines connecting these three selected corners forming a regular triangle.

5. The resin-made container according to claim 1, wherein the container is a PET bottle.

6. The resin-made container according to claim 2, wherein the container is a PET bottle.

7. The resin-made container according to claim 3, wherein the container is a PET bottle.

8. The resin-made container according to claim 4, wherein the container is a PET bottle.

* * * * *